US009299466B2

(12) United States Patent
Isensee et al.

(10) Patent No.: US 9,299,466 B2
(45) Date of Patent: Mar. 29, 2016

(54) SYSTEM FOR PROCESSING AND TRACKING RADIONUCLIDES

(71) Applicant: NorthStar Medical Radioisotopes LLC, Madison, WI (US)

(72) Inventors: Glenn H. Isensee, Madison, WI (US); Lionel Johnson, Madison, WI (US)

(73) Assignee: NORTHSTAR MEDICAL RADIOISOTOPES LLC, Madison, WI (US)

( * ) Notice: Subject to any disclaimer, the term of this patent is extended or adjusted under 35 U.S.C. 154(b) by 0 days.

(21) Appl. No.: 14/528,914

(22) Filed: Oct. 30, 2014

(65) Prior Publication Data

US 2015/0162106 A1 Jun. 11, 2015

Related U.S. Application Data

(60) Provisional application No. 61/897,482, filed on Oct. 30, 2013.

(51) Int. Cl.

| | |
|---|---|
| ***G21F 5/06*** | (2006.01) |
| ***G21F 5/015*** | (2006.01) |
| ***G21H 5/02*** | (2006.01) |

(52) U.S. Cl.

CPC *G21F 5/015* (2013.01); *G21F 5/06* (2013.01); *G21H 5/02* (2013.01)

(58) Field of Classification Search

None

See application file for complete search history.

(56) References Cited

U.S. PATENT DOCUMENTS

| | | | | |
|---|---|---|---|---|
| 5,154,897 | A * | 10/1992 | Ehrhardt et al. | 423/6 |
| 2002/0195391 | A1* | 12/2002 | Young et al. | 210/656 |
| 2004/0051368 | A1* | 3/2004 | Caputo et al. | 299/1.9 |
| 2006/0004491 | A1* | 1/2006 | Welch | A61K 51/1282 700/266 |
| 2008/0260580 | A1* | 10/2008 | Helle et al. | 422/63 |
| 2008/0277594 | A1* | 11/2008 | Wagner et al. | 250/432 PD |
| 2009/0309466 | A1* | 12/2009 | Quirico et al. | 312/209 |
| 2010/0312039 | A1* | 12/2010 | Quirico et al. | 600/4 |
| 2011/0178359 | A1* | 7/2011 | Hirschman et al. | 600/4 |

(Continued)

OTHER PUBLICATIONS

R&D, "Making quick work of radionuclides", http://www.rdmag.com/award-winners/2010/08/making-quick-work-radionuclides, Aug. 11, 2010.*

*Primary Examiner* — Michael Logie

(74) *Attorney, Agent, or Firm* — Husch Blackwell LLP

(57) ABSTRACT

An apparatus for processing a radionuclide including a parent radionuclide that decays over time into a daughter radionuclide, a separation column that separates the daughter radionuclide from the parent radionuclide, a plurality of valves and at least one pump that operate to separate the daughter radionuclide from the parent radionuclide and deliver the daughter radionuclide into the daughter radionuclide container by alternately connecting at least two of the parent radionuclide container, the daughter radionuclide container, the separation column container and the plurality of processing containers, a plurality of RFID tags including an RFID tag of the plurality of RFID tags affixed to each of the daughter radionuclide container and the separation column and a programmed processor that reads an identifier of each of the plurality of RFID tags, an identifier and position of each of the plurality of valves and pump and saves the identifiers, positions and operations into a tracking file.

10 Claims, 2 Drawing Sheets

(56) References Cited

U.S. PATENT DOCUMENTS

2011/0201867 A1* 8/2011 Wagner ..... 600/5
2012/0053457 A1* 3/2012 Fago ..... 600/432
2015/0123021 A1* 5/2015 Isensee ..... 250/507.1
2015/0165341 A1* 6/2015 Isensee ..... 210/91
2015/0209504 A1* 7/2015 Lemer ..... G21G 1/0005 600/432

* cited by examiner

SYSTEM FOR PROCESSING AND TRACKING RADIONUCLIDES

This Application is a continuation-in-part of U.S. Provisional Patent Application No. 61/897,482 filed on Oct. 30, 2013.

FIELD OF THE INVENTION

The field of the invention relates to nuclear medicine and more particularly, to methods of processing radioactive nuclides.

BACKGROUND OF THE INVENTION

The use of radioactive materials in nuclear medicine for therapeutic and diagnostic purposes is known. In the case of diagnostic medicine, radioactive material may be used to track blood flow for purposes of detecting obstructions or the like. In this case the radioactive material (e.g., a tracer) may be injected into a vein of the arm or leg of a person.

A scintillation camera may be used to collect images of the person following the injection. In this case, the gamma rays of the tracer interact with a detector of the camera to create images of the person.

A series of images may be collected of the person as the tracer perfuses through the person. Since the tracer diffuses through the blood of the person, the veins or arteries with greater blood flow produce a greater signature from the tracer.

Alternatively, radioactive material may be coupled at a molecular level with a biolocalization agent. In this case, the biolocalization agent may concentrate the radioactive material at some specific location (e.g., the site of a tumor).

Key to the use of radioactive materials in nuclear medicine is the creation of nuclear materials with a relatively short half life (e.g., 2-72 hours). In the case of the use of the radioactive materials with a biolocalization agent or for imaging, the short half life causes the radioactivity to decay rapidly in such as way as to prevent radiation damage to surrounding tissue.

While the use of radioactive materials in nuclear medicine is extremely useful, the handling and tracking of such materials must be rigorous. Accordingly, better methods are needed to identify and track such materials.

DETAILED DESCRIPTION OF AN ILLUSTRATED EMBODIMENT

Figure 1:
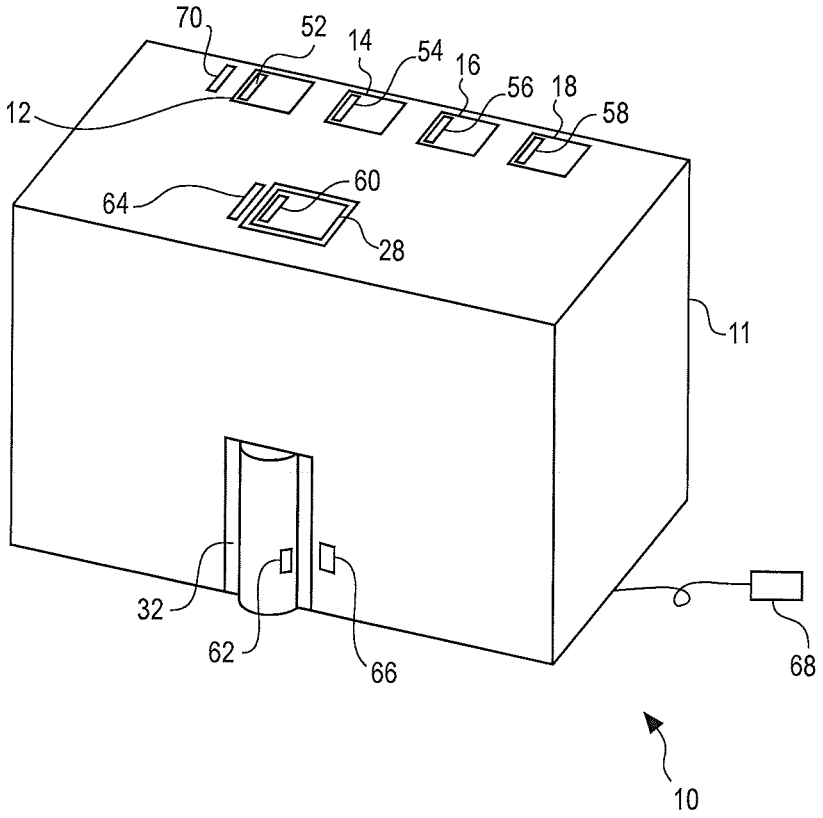
FIG. 1 is a front, perspective view of a device for processing radionuclides shown generally in accordance with an illustrated embodiment of the invention.
Figure 2:
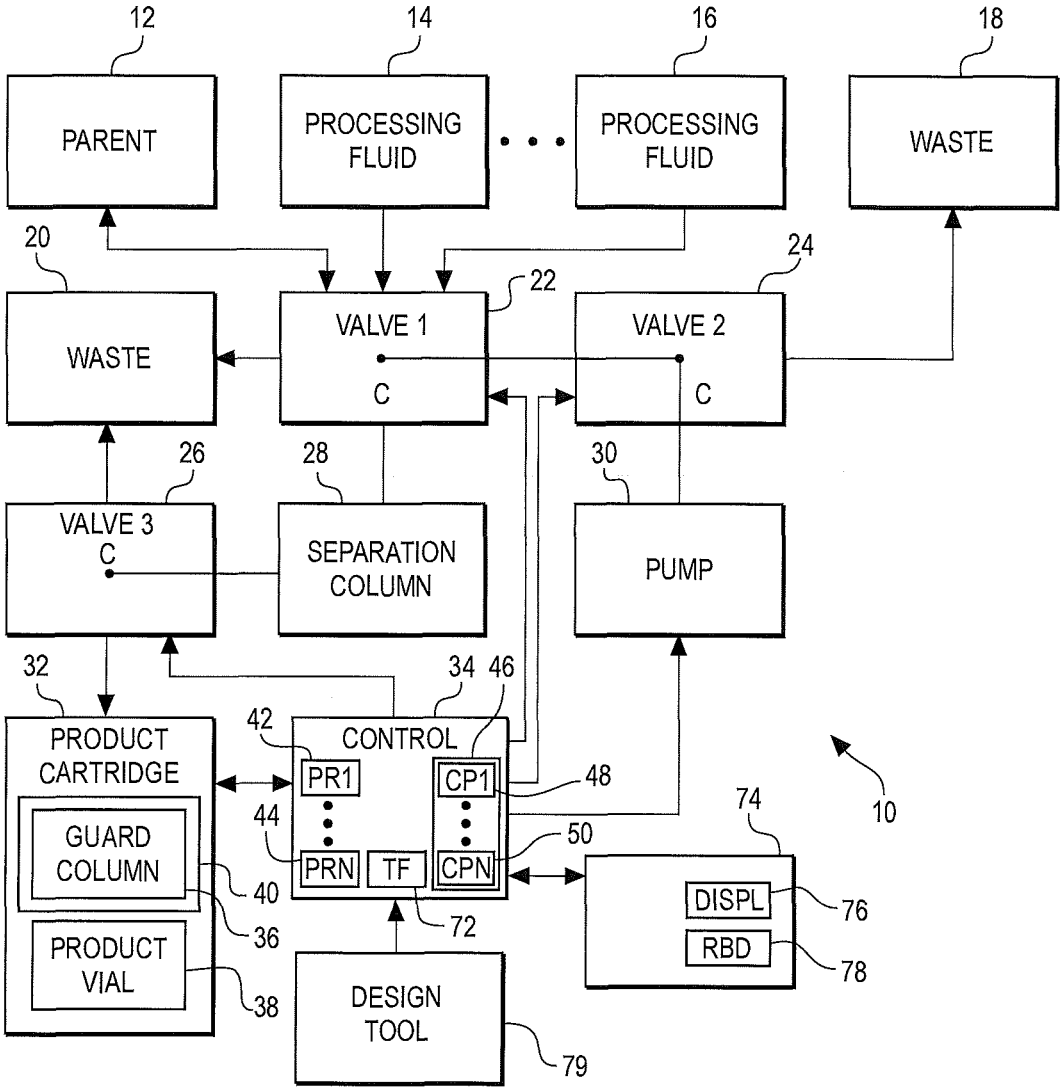
FIG. 2 is block diagram of the processing element of the device of FIG. 1.

FIG. 1 is a front perspective view of the device and system 10 for processing and separating radionuclides shown generally in accordance with an illustrated embodiment of the invention. FIG. 2 is a block diagram of the separation system 10. The system 10 may be used to provide highly purified radioactive materials for use in diagnostic or therapeutic processes. The system 10 may be constructed as a portable device that is simple to use in radionuclide production facilities, nuclear pharmacies or in some other medical environment.

The system 10 may be used to separate a parent radionuclide from a daughter radionuclide using a forward COW process and where the daughter radionuclide is produced by the decay of the parent radionuclide. The system 10 may also be used to separate a daughter radionuclide from a parent radionuclide using a reverse COW process.

Included within the system 10 may be one or more separation columns 28, 36. The separation column 28 may be selected for purification of a wide range of radionuclides depending upon the diagnostic or therapeutic objectives. For example, the separation columns 28, 36 may be filled within a chromatographic material (e.g., ion-exchange resin, extraction chomotographic material, etc.) targeted for the specific radionuclide needed. In this regard, the system 10 may be used for the purification of yttrium-90, bismuth-212 and 213, or rhenium-188 for radiotherapy or technetium-99 m, thallium-201, fluorine-18 or indium-111 for diagnostic imaging.

In order to ensure the content and integrity of the radionuclide produced as an end product, the system 10 may operate under the control of an automatic controller 34. One or more computer processing apparatus (e.g., processors, host, etc.) 42, 44 programmed with and operating under the control of one or more computer programs 48, 50, loaded from a non-transitory computer readable medium (e.g., a memory) 46, may coordinate and track the preparation of each radionuclide. As used herein, reference to a step performed by a computer program is also reference to the processor that executed that step.

Coupled to the controller is a user interface 74. The user interface includes a display 76 and a keyboard 78. Alternatively, the user interface may be implemented as a touch screen control.

In order produce a particular radionuclide product, the user may select a program associated with the radionuclide. The program defines a set of steps for producing that radionuclide as well as the raw materials and hardware components necessary to produce the radionuclide. For example, the program may define a respective UPC or other identifier for the separator column needed for the product, for the parent radionuclide, for the contents of the processing fluids and for the product vial the holds the completed radionuclide.

Upon activating the program, the program may read identifiers from the separator column and each attached container (if already installed) or may prompt the user via the display to install the separation column and/or proper containers. If any of the devices (e.g., separator column, parent radionuclide, processing solutions, finished product vial, etc.) are incorrect (as verified by reading the identifier on the device), then the program will prompt the user to make the appropriate corrections.

The program may also depict a number of visual prompts on the display in order to guide the user. For example, the program may detect a missing device (e.g., separator column) and display a prompt identifying the proper separator column and where it should be installed. The prompt of where the separation column should be installed may be accomplished be depicting a perspective view of the system shown in FIG. 1 along with an indicator of the location of the separation column. The indicator may be a flashing arrow or by highlighting the receptacle for the separation column.

Once the program confirms that the correct devices and raw materials are present, the program may display a prompt requesting permission to proceed. If the user provides permission to proceed, the program may display a sequence of flow diagrams that define the process (e.g., a simplified piping diagram such as shown in FIG. 2) where process flows are indicated by highlighting the proper flow paths in green. If a malfunction occurs, the program may highlight the proper flow paths in red to indicate the absence of flow.

Turning now to the operation of the system in more detail, the system 10 may be provided with a parent radionuclide within a radiation impervious container 12. After some period of time, some of the parent radionuclide will decay to produce a mixture of parent and daughter radionuclides. In order to begin preparing a radionuclide, a first product processor 42, 44 of the controller 34 (operating under control of the selected program) may first activate one or more valves 22, 24, 26 and a pump 30 to transport the mixture of the parent and daughter radionuclides from the parent container 12 to a separation column 28 that captures the daughter radionuclide. Once the mixture of parent and daughter radionuclides has passed through the separation column 28, the remaining parent may be transported back to a storage container 12.

The controller 34 may wash the daughter radionuclide within the first separation column 28 by activating valves 22, 24 to first withdraw a wash solution from a processing fluids container 14, 16, to then route the wash solution through the separation column 28 and then to discard the wash solution into a waste container 18, 20. The wash process may be repeated any of a number of times with the same or different types of wash solutions.

Once washed, the controller 34 may withdraw a stripping solution from one of the processing fluids containers 14, 16 and then pump the stripping solution through the first separation column 28, through valve 26 and into the product cartridge assembly 32. The stripping solution functions to release the daughter radionuclide from the separator column 28 and then transport the daughter radionuclide into the product cartridge assembly 32.

In order to ensure the integrity of the radionuclide, the controller 34 may perform a number of steps (before, during and after the processing steps) in order to confirm the identity of the raw materials used to create the radionuclide as well as to track the product cartridge 32. In this regard, a first processor (e.g., a processing parameters processor) 42, 44 may first receive an identifier (e.g., a file name) of a type of radionuclide to be prepared by the system 10 from the program selected by the user. Based upon the identifier, the processing parameters processor 42, 44 may retrieve the file identifying the steps and raw materials needed to create the radionuclide. The processing parameters processor 42, 44 may also create a radionuclide tracking file 72 within a memory of the controller 34.

Next, another processor (e.g., an identification processor) or the same processor 42, 44 may read an identifier from the containers 12, 14, 16, 18, 28, 32. The identifier in this case may consist of unique identifier read from a radio frequency identification (RFID) tag 52, 54, 56, 58, 60, 62 attached to one or more of the containers 12, 14, 16, 18, 28, 32. In this case, the identification processor 42, 44 may activate a corresponding RFID reader 64, 66, 68, 70 to read the RFID tags 52, 54, 56, 58, 60, 62.

At least some of the RFID readers 64, 66, 70 may be associated with a container receptacle. For example, the container 32 placed into the receptacle shown in FIG. 1 may receive the daughter radionuclide at the completion of the processing routine. Within the receptacle, a product container RFID reader 66 operates to read the RFID 62 in order to confirm and track the destination of the radionuclide processed by the system 10. In this regard, the identification processor 42, 44 may read the RFID 62 of the product container 32 at the beginning of the process and at the end of the process.

Similarly, the separation column 28 is very specific to the type of parent/daughter radionuclide to be separated. By reading the RFID 60 on the separator column 28 during use, the system 10 is able to confirm that the separator column 28 would be effective for the particular radionuclide to be prepared and that it has not been in use too long to be ineffective for its intended use.

Other readers (e.g., reader 68) may be provided as a portable device to read processing fluid containers 14, 16, 18. Since the fluids within these containers 14, 16, 18 is of less criticality, the identifiers of these containers do not need to be read as rigorously.

The parent radionuclide container 12 may also use a reader 70 within a receptacle for the container 12. Alternatively, if because of the necessity of shielding, the container 12 cannot be used within a receptacle, the portable reader 68 may be used.

As the identifier of each container 12, 14, 16, 18, 28, 32 is read, it is saved to the tracking file 72 for the radionuclide. Similarly, the processing steps used to create the radionuclide including an identifier of the step, the time executed and the duration may also be saved to the tracking file. Once a radionuclide is completed, a printout of the tracking file 72 may be provided as a hardcopy to accompany the product container 32 to its point of use.

The software architecture of the programs incorporates a database for complete time and use correlation of multiple componentry (components) during a radiochemical processing procedure. This is accomplished, in part, via the RFID readers identifying each respective component and confirming that the use of each component is authorized in the context of the product to be produced.

The protocol used for each product is very specific to the product. The protocol is a linear series of steps that functions to perform a radiochemical separation including but not limited to user prompts, graphical representations, troubleshooting, timing, repeatable method steps, error reporting, event monitoring, alerts and notifications.

Production of each product may also operate by incorporation of specific security "signed" protocols (i.e. programs). The signed protocols are identified by author, data and time. The protocols are stored as permanent instrument operational documentation. This provides a comprehensive security scheme for the use of pre-stored protocols, without allowing modification to drug manufacture procedures.

The incorporation of "security and use" logic operates to minimize adverse events to user or product. The security and use logic is based upon a number of requirements including: 1) a User ID with password and 2) Security settings (by user), specific to drug batch production documentation. These features helps minimize adverse events to untrained personnel or unauthorized use of the instrumentation.

The use of radiofrequency identification of components further operates to correlate properly installed chemistry components in order to implement safety controls and prevent adulterated drug products. This feature aids in identification of a properly set up system, provides interrogation of raw material components used in the manufacture of a drug, prompts the system in the event of removal or tampering during use, provides post-programming data collection and storage to validate the number of uses (including one-time), provides manufacturing traceability based upon user records in the tracking file for complete drug tracing and history.

The tracking file operates by incorporation of a single access database to record: 1) User login; 2) Instrument configurations; 3) UTC time labeling of each user and instrument action. The tracking file also incorporates a record of instrument events during use. The tracking file provides: 1) a method of tracking lot and providing source controls for creation of a medical drug; 2) a method of safety controls to prevent reuse or expiration of raw materials; 3) a method of enforcing safety controls to minimize operator error and maximize radiation safety; 4) a method of using authorized protocols only (prevention of tampering), with a permanent history of operational protocols for drug products.

The tracking file provides a complete historical archive and database record (session log) of the production sequence and appropriate time stamps. The tracking file also provides retrospective logging information useful for period of use, daily operating sequences, calculations of yield, etc. This feature enables a retrospective review of all manufacturing data for a drug, provides service personnel with an appropriate record used in troubleshooting for malfunctions, provides a use history of the instrument and permanent storage of a list of authorized users.

The display provides a graphical representation to indicate a status of the instrument and to guide a user through a sequence of steps facilitating minimal error including: 1) choice of pre-programmed protocols; 2) start, stop, pause controls; 3) textual based messaging; 4) instrument diagrams corresponding to processing activity, etc. This is a unique feature in that the graphical interface shows progress in a particular program by changes to a component diagram, updates the user continually with status information, provides indications for acceptable operating conditions, conclusive evidence of completed sequences, and choice of pre-programmed operating protocol.

The controller also incorporates the use of a protocol design tool that identifies author, date and time information which operates to restrict the system to operation using distributed authorized protocols only; that is, the drug batch manufacturing method cannot be altered except by authorized personnel.

The distributed authorized protocols creates a series of instrument control steps in a finite and repeatable sequence. These protocols, programs and/or other features establishes the conditions for proper operation. The design tool 79 is crucial to the control and use of pre-programmed protocols by the instrument and prevents alteration of approved drug manufacturing methods. In addition, the design tool provides identification of protocols for service and manufacturing outside of the scope of normal drug manufacturing.

The controller may also implement and use a reverse role architecture where initially a host computer is the administrator and control node of the system. The host authorizes use and protocol selection. Upon initiation of a protocol, the host computer becomes a slave to the instrument, reversing its role as an administrator and authorizing the instrument microprocessor system to assume all processing controls. At that time the microprocessor controls the operation sequence and also reporting its status as requested. Upon conclusion of a protocol, the host computer role reverts back to an administrator and is responsible for all archive activities. This feature isolates the host computer system from disrupting the instrument protocol operations during the time sensitive and sequential processing of radioactive materials. When the processing is complete, the instrument will relinquish control back to the host. Safety stops and certain user controls on the host however do remain active and are interpreted by the microprocessor as needed.

In general, the system of FIGS. 1 and 2 includes a container that contains a parent radionuclide that decays over time into a daughter radionuclide, a container that contains a separation column that separates the daughter radionuclide from the parent radionuclide, a container that contains the separated daughter radionuclide, a plurality of containers for processing fluids, a plurality of valves that operate to separate the daughter radionuclide from the parent radionuclide and deliver the daughter radionuclide into the daughter radionuclide container by alternately connecting at least two of the parent radionuclide container, the daughter radionuclide container, the separation column container and the plurality of processing containers, a plurality of RFID tags including an RFID tag of the plurality of RFID tags affixed to each of the daughter radionuclide container and the separation column and a programmed processor that reads an identifier of each of the plurality of RFID tags, an identifier and position of each of the plurality of valves and saves the identifiers and positions into a tracking file.

A specific embodiment of method and apparatus for generating radionuclides has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

The invention claimed is:

1. An apparatus comprising:

a container that contains a parent radionuclide that decays over time into a daughter radionuclide;

a container that contains a separation column that separates the daughter radionuclide from the parent radionuclide;

a container that contains the separated daughter radionuclide;

a plurality of containers for processing fluids;

a plurality of valves and at least one pump that operate according to a predetermined process to separate the daughter radionuclide from the parent radionuclide and deliver the daughter radionuclide into the daughter radionuclide container by alternately connecting at least two of the parent radionuclide container, the daughter radionuclide container, the separation column container and the plurality of processing containers;

a plurality of RFID tags including an RFID tag of the plurality of RFID tags affixed to each of parent radionuclide container, the daughter radionuclide container and the separation column;

a host computer; and a programmed processor that reads an identifier of each of the plurality of RFID tags, an identifier of each of the plurality of valves and reads a position of each of the plurality of valves during one or more steps of the predetermined process and saves the identifiers of the RFID tags and valves, the positions of the valves and a duration of each step of the predetermined process into a tracking file for each batch of daughter radionuclide produced, the tracking file providing a historical archive of the production sequence and time stamps.

2. The apparatus as in claim 1 further comprising a product processor that activates the plurality of valves in sequence.

3. The apparatus as in claim 1 further comprising an RFID reader disposed in a receptacle of the separation column container that reads the identifier of the RFID of the separation column container.

4. The apparatus as in claim 1 further comprising an RFID reader disposed in a receptacle of the daughter radionuclide container that reads the identifier of the RFID of the daughter radionuclide container.

5. The apparatus as in claim 1 further comprising a plurality of processing programs where at least one of the plurality of processing programs defines a set of steps for separating the daughter radionuclide from the parent nuclide.

6. The apparatus as in claim 5 further comprising a display that depicts each of the plurality of processing programs for selection by a user.

7. The apparatus as in claim 6 further comprising a flow diagram depicted on the display showing an instantaneous flow of radionuclides through the system.

8. The apparatus as in claim 7 wherein the flow diagram is a static display and where only paths of a desired flow are highlighted.

9. The apparatus as in claim 1 further comprising a processor that saves a record of each instrument event into the tracking file.

10. An apparatus comprising:

a parent radionuclide that decays over time into a daughter radionuclide;

a separation column that separates the daughter radionuclide from the parent radionuclide;

a plurality of valves and a pump that operate to separate the daughter radionuclide from the parent radionuclide and deliver the daughter radionuclide into a daughter radionuclide container;

a plurality of RFID tags including an RFID tag of the plurality of RFID tags affixed to each of parent radionuclide container and the separation column; and a programmed processor that reads an identifier of each of the plurality of RFID tags, an identifier for each of the plurality of valves and positions each of the plurality of valves during one or more steps of the predetermined process and saves the identifiers of the RFID tags and valves, the positions, and a duration of each step of the predetermined process into a tracking file for each batch of daughter radionuclide produced, the tracking file providing a historical archive of the production sequence and time stamps.

* * * * *